United States Patent [19]

Reymond

[11] 3,942,762

[45] Mar. 9, 1976

[54] WINCH FOR SAILING SHIPS

[76] Inventor: Marc Reymond, 128 rue Bergson, 4200 Saint-Etienne-Loire, France

[22] Filed: May 17, 1974

[21] Appl. No.: 471,055

[30] Foreign Application Priority Data

May 18, 1973 France ..... 73.18813

[52] U.S. Cl. ..... 254/150 R; 74/812

[51] Int. Cl.[2] ..... B66D 1/30

[58] Field of Search ..... 254/175.7, 175.5, 186 R, 254/187 E, 186 HC, 150 R; 74/812, 416, 420; 192/48.91

[56] References Cited

UNITED STATES PATENTS

| | | | |
|---|---|---|---|
| 2,788,681 | 4/1957 | Kling | 74/812 |
| 3,175,568 | 3/1965 | Kafka | 192/48.91 |
| 3,618,896 | 11/1971 | Bewley | 74/812 |
| 3,728,914 | 4/1973 | Guangorina | 74/812 |
| 3,802,665 | 4/1974 | Fawcett | 74/812 |

FOREIGN PATENTS OR APPLICATIONS

| | | | |
|---|---|---|---|
| 1,124,653 | 3/1962 | Germany | 254/175.7 |

*Primary Examiner*—Robert J. Spar
*Assistant Examiner*—Kenneth Noland
*Attorney, Agent, or Firm*—Haseltine, Lake & Waters

[57] ABSTRACT

A winch or capstan primarily for tightening the sails of a ship and having a winch head driven always in one direction only at a selected one of four speed ratios. A planetary transmission and free wheel arrangement provide two of the speed ratios corresponding to clockwise and counter-clockwise rotation of a control shaft. A sprocket and chain arrangement drive by handwheels is housed in two casings mounted at one end of the shaft, the driven sprocket in one casing being moveable into dog-clutch engagement with one or the other of two gear trains coupled with the shaft to provide the two further speed ratios.

11 Claims, 4 Drawing Figures

FIG. 1
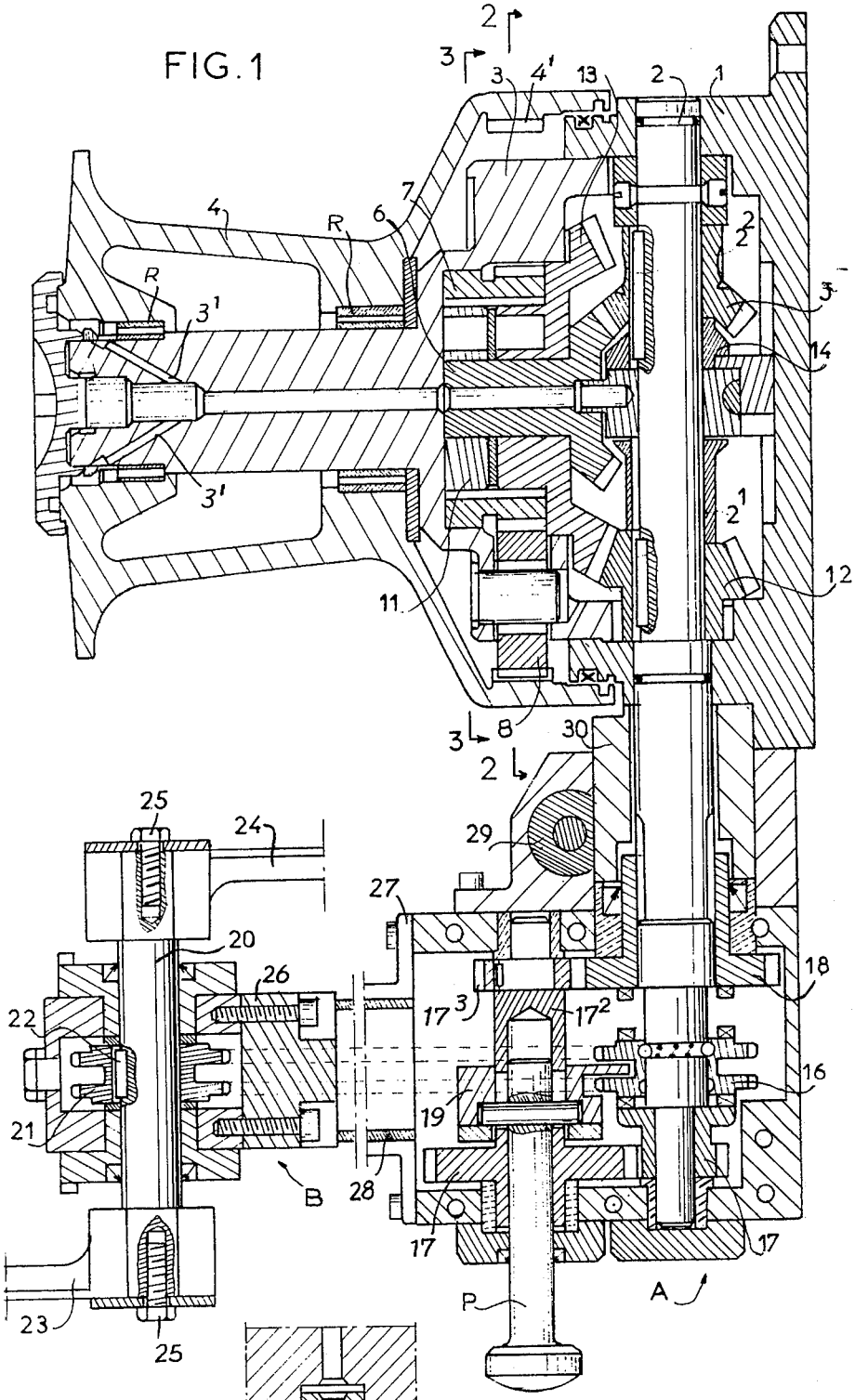
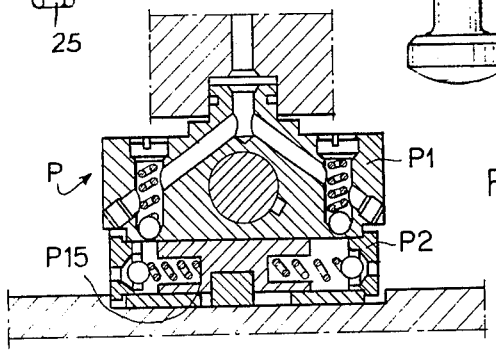
FIG. 4

WINCH FOR SAILING SHIPS

FIELD OF THE INVENTION

This invention relates to a winch.

The invention is particularly, but not exclusively, concerned with the type of "winch" as employed on naval vessels, particularly sailing ships. Such winches employed on sailing vessels (sometimes known as "roller capstans") are employed in the navigation of sail ships and are intended to tighten the sail by winding the rope on a capstan head. It is known to provide a roller capstan in which the capstan head is controlled manually to turn always in the same direction but with only two speeds. Furthermore, all of the internal gear train, generally made of stainless steel or bronze, does not provide considerable resistance to stresses.

SUMMARY OF THE INVENTION

According to one aspect of the invention there is provided a winch having a uni-directional rotary output and comprising; a housing, a control shaft rotatably mounted in said housing, drive means coupled with said shaft, a winch head mounted for rotation relative to said housing, and gear means coupled with said control shaft and with said winch head, said gear means being arranged to provide rotation of the winch head at a given speed ratio in one direction when the control shaft is rotated in a first direction and to provide rotation of the winch head at a relatively different speed ratio, also in said one direction, when the control shaft is rotated in a second direction opposite to said first direction.

According to another aspect of the invention there is provided a winch comprising; a housing, a control shaft rotatably mounted in said housing, a winch head mounted for rotation relative to the housing, gear means coupled with said shaft and with said winch head, and drive means coupled with said shaft, said drive means comprising a first rotary drive means, a second rotary drive means in driving engagement with said first drive means, and pre-selectable first and second drive trains coupled with the shaft to apply relatively different speed ratios to said shaft, said second rotary drive means being selectively moveable into driving engagement with one or the other of said drive trains.

BRIEF DESCRIPTION OF THE DRAWINGS

The invention will now be described in more detail, by way of example only, with reference to the accompanying drawings in which:

FIG. 1 is a front view, partly in section, of one embodiment of winch according to the invention;

FIG. 4 is a front view and in section of a lubrication arrangement for the winch.

DESCRIPTION OF PREFERRED EMBODIMENTS

Figure 2:
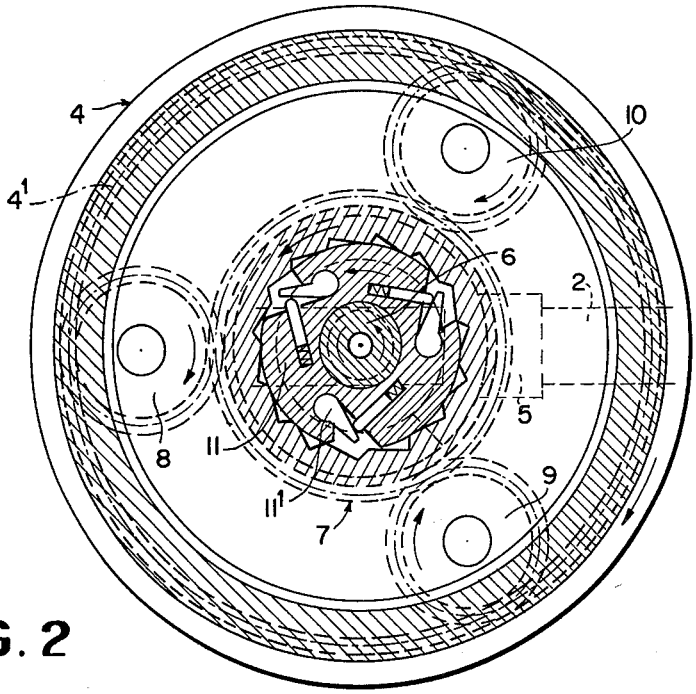
FIG. 2 is a sectional view taken on line 2—2 in FIG. 1.

Referring now to the drawings, there is shown a winch which is particularly suitable for employment in a sailing ship in order to tighten the sails thereof. However, it is to be understood that a winch according to the invention is not limited to such use of the winch. The winch or roller capstan comprises a casing support 1 in which is rotatably mounted a control shaft 2, a satellite or planetary pinion carrier 3 and a capstan head 4.

As will be described in more detail below, the capstan head 4 can be rotated in one direction only at any selected one of four speed ratios. To this end, the control shaft 2 is provided with appropriate gear means housed within the casing 1 to provide two different speed ratios in one direction for the capstan head 4 for rotation in one, or the other, direction of rotation of the shaft 2. To provide two further speed ratios, pre-selectable drive means are provided at one end of the shaft 2 and which can be operated by either one or both of hand wheels 23 and 24. A push-button control P is provided which can be operated to select which mode of operation is applied to the control shaft 2 whereby a total of four different speed ratios in one direction can be provided for the capstan head 4.

Concerning the gear train provided within the casing 1 first of all, the control shaft 2 has a bevel gear 5 coupled therewith by means of a key $2^2$, the bevel gear 5 being in mesh with a further bevel gear 6 (to form a first pair of bevel gears) having a cylindrical portion housed, and drivingly engaged, with an inner portion of a free wheel 11. As shown in more detail in FIG. 2, an outer portion of the free wheel 11 is provided with pawls 11' which can engage, in one direction of rotation of the free wheel, with an inner portion of a central (sun) gear 7. It will be evident that, for relative rotation of the free wheel 11 in an opposite direction no drive will be imparted by the free wheel to the gear 7.

Figure 3:
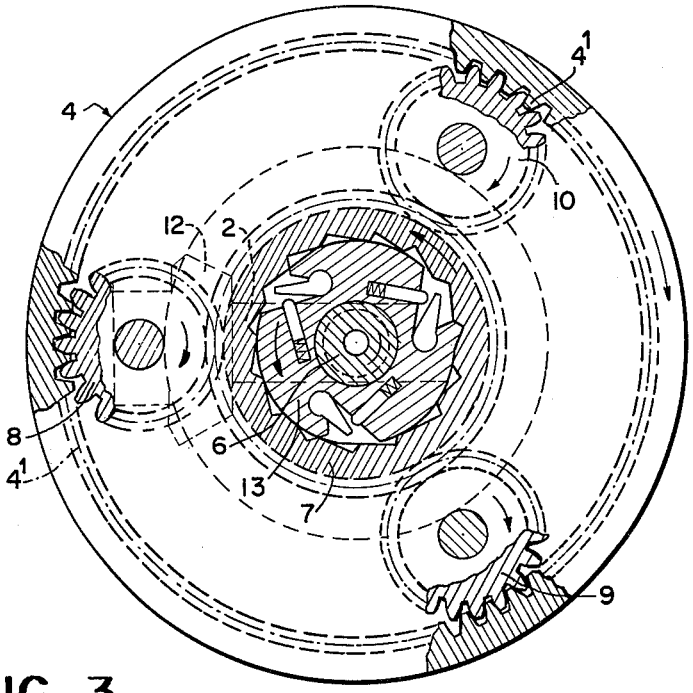
FIG. 3 is a sectional view taken on line 3—3 in FIG. 1.

The gear 7 is in mesh with planetary pinions 8, 9 and 10 which are supported by the carrier 3 and, in turn, are in mesh with an internal ring gear 4' provided on the capstan head 4. Thus, rotation of the control shaft 2 in one direction can give rise to rotation of the capstan head 4 at a given speed in one direction. However, the shaft 2 also has a bevel gear 12 coupled therewith, the bevel gear 12 being mounted on a key $2^1$. The bevel gear 12 is in mesh with the conical teeth of a crown wheel 13 to form a second pair of bevel gears. The crown wheel 13 has a cylindrical portion which is freely turnably mounted on a cylindrical bearing surface of the bevel gear 6. As mentioned above, an inner portion of the free wheel 11 is coupled directly to the bevel gear 6, and has a uni-directional connection with the gear 7 by means of the pawls 11'. Similarly, the crown wheel 13 has a number of apertures one of which is shown in FIG. 1, in which pawls, (FIG. 3) similar to pawls 11', are received and which also provide the same uni-directional drive to the gear 7, though at a different speed ratio. However, this drive will be transmitted only when the direction of rotation of shaft 2 is reversed relative to the rotation providing drive to the head 4 from bevel gear 5, 6.

Thus, for rotation of the control shaft 2 in an opposite direction, drive is transmitted to the capstan head 4 by way of the bevel gear 12, crown wheel 13 and thence to the gear 7, the gear 7 then driving the planetary pinions 8, 9 and 10, in similar manner to that described above for the rotation of the shaft 2 in the first direction. It will be noted particularly that the rotation imparted to the capstan head 4 remains in the same direction as described above, though at a different speed ratio. The capstan head 4 therefore turns always in the same direction, the rotation opposed to it being prevented by the opposition of the pawls of the free wheel 11 and of the crown wheel 13.

All the internal gear train housed in casing 1 is made of case hardened steel so as to provide much greater resistance to stresses and therefore a lubrication system is provided for the gear train. The lubrication system comprises a pump P (FIG. 4) comprising a pump body P1, two valves P2 and a piston P15 which is controlled by the rotation of the shaft 2. This is achieved through the intermediary of a fork and an eccentric 14 which promotes the functioning of the piston P15. Thus, in operation, lubrication oil is projected by the pump through the longitudinal passage of the planetary pinion carrier 3 towards the top of the capstan head 4 and then passes through three passages $3^1$ formed in the end of the cylindrical portion of the carrier 3 to be supplied to two needle roller bearings R provided to permit rotation of the capstan head 4 relative to the carrier 3. The lubrication oil falls onto the upper of the two needle roller bearings R and then passes by gravity to the lower needle roller bearing R and thence to the lower gear train mechanism. Appropriate sealing joints are provided at important locations in order to provide liquid tightness for the lubrication system.

It will be evident from the foregoing description that the control shaft 2 and the associated gear train mechanism in housing 1 is capable of turning the capstan head 4 always in the same direction, but with two relatively different speed ratios. However, as will now be described below the further arrangement applied to one end of the control shaft 2 provides two further possible gear reduction ratios which can be preselected so as to permit preselection of any one of four possible speed ratios for the capstan head 4 and always in the same direction.

As mentioned above, the drive to the capstan head 4 is achieved by rotation one or both of hand wheels 23 and 24 (forming manually operable drive means) which are coupled with one end of the control shaft 2 by the mechanism described below. A lower casing A is mounted around a stepped end of the control shaft 2 and mounts a pinion 17 on a narrowest end portion of the shaft 2 and a pinion 18 on a larger diameter portion of the control shaft 2. The pinion 17 is rotatable idly on the shaft 2, whereas the pinion 18 is solid with the shaft 2 and is capable of applying rotation thereto. A drive sprocket 16 is slidably mounted on an intermediate stepped portion of the control shaft 2 and can be moved axially of the shaft between dog-clutch engagement with pinion 17 as shown in FIG. 1 to dog-clutch engagement with pinion 18. Depending upon which of two gear trains (pinion 17 or 18) is engaged by the sprocket 16, will determine the gear reduction ratio provided between the control shaft 2 and the hand wheels 23 or 24.

To effect axial sliding movement of the sprocket 16 between either one of its two operating positions, a pushbutton P is provided which is mounted for axial sliding movement in casing A and carries a fork 19 which is engageable between two flange portions of the double sprocket 16 to effect axial displacement thereof. If desired, a control lever may be coupled with the push-button P. In addition to being slidably mounted in the casing A, the push-button P also is slidable axially within a pinion $17^1$ which is in mesh with pinion 17 idly mounted on the end of control shaft 2. The pinion $17^1$ has a cylindrical extension $17^2$ which mounts, at one end, a further pinion $17^3$ which is in mesh with pinion 18.

In the position of engagement of sprocket 16 shown in FIG. 1, rotation of the sprocket 16 by one or the other of the hand wheels 23 and 24 causes application of rotation to the control shaft 2 by way of the dog-clutch engagement with pinion 17, from pinion 17 to pinion $17^1$, and through shaft portion $17^2$ to pinion $17^3$ and thence ultimately to pinion 18. In the event of depression of the push-button P, the drive sprocket 16 is moved out of clutching engagement with pinion 17 and into dog-clutch engagement with pinion 18 to apply drive directly thereto. Evidently, this will apply a different speed ratio to the control shaft 2. Although a drive connection will remain between pinion 18 and pinion $17^3$ and ultimately to pinion 17, it will be remembered that pinion 17 is idly rotatable on the end of control shaft 2.

As mentioned above, the hand wheels 23 and 24 control the application of drive to the control shaft 2 and thence to the capstan head 4. To this end, the hand wheels 23 and 24 are mounted at opposite ends of a shaft 20 by means of screws or bolts 25. The shaft 20 is mounted in an upper casing B and is provided with a drive sprocket 21 engaged by a key 22 which limits or stops the translational movement of the drive sprocket 21. The drive sprocket 21 is a double sprocket and is in driving engagement with sprocket 16 in casing B by means of a pair of chains shown in dash lines in FIG. 1. The casings A and B are interconnected by means of two tubes 28 made of stainless steel which are connected to support shoes 26 and 27 of the casings B and A respectively. The two tubes 28 of stainless steel permit the passage of the two runs of the chains inter-connecting the pinions 16 and 21. Thus, the two casings A and B define a control assembly which transmits through the intermediary of pinion 18, in one direction or the other depending on the direction of rotation of the hand wheels 23, 24, two different speed ratios according to the clutching effected on the pinion 17 or the sleeve pinion 18.

The fitting of the idle pinion 17 on the smallest stepped portion of the shaft 2 provides for easy assembly of the casings A and B on the control shaft 2 and hence relative to the "capstan head" part of the device. Locking in the desired position can be effected by means of two tangential stoppers 29 which can approach each other under the action of an adjusting screw, to come to lock themselves to a sleeve 30 solid with the capstan head assembly. By this means, the control assembly formed by the casings A and B is orientable angularly with reference to the capstan head assembly and can thus be immobilized in a preferred position.

The advantages of the winch or roller capstan described above, inter alia, are that according to the direction of rotation of the hand wheels 23 and 24 and according to the pinion engaged by drive sprocket 16, four different gear reductions can be obtained and applied to rotate the capstan head 4. Thus, for one complete rotation of one or the other of the hand wheels 23 and 24, one can obtain four different gear ratios applied to the rotation of the capstan head 4.

The control assembly constituted by the lower and upper casings A and B is orientable and can be fixed in the desired position.

It should be noted that, if desired, the two hand wheels 23 and 24 can be constructed to be extensible in order to be shortened or lengthened in a manner to diminish or increase the length of the lever arm.

While it is preferred that the winch or roller capstan described above be employed in conjunction with naval sailing vessels, in order to tighten the sails by winding cordage around the capstan head, it is to be understood that the winch is not limited to such use and can be employed in many other situations in which winding or tensioning is to be applied to cordage or other flexible tensile elements.

I claim:

1. A winch having a uni-directional rotary output and comprising:

a housing, a control shaft rotatably mounted in said housing, drive means coupled with said shaft, a winch head mounted for rotation relative to said housing, and gear means coupled with said control shaft and with said winch head, said gear means being arranged to provide rotation of the winch head at a given speed ratio in one direction when the control shaft is rotated in a first direction and to provide rotation of the winch head at a relatively different speed ratio, also in said one direction, when the control shaft is rotated in a second direction opposite to said first direction, said drive means comprising a first rotary drive means, a second rotary drive means in driving engagement with said first rotary drive means, and pre-selectable first and second drive trains coupled with the shaft to apply relatively different speed ratios to said shaft, said second rotary drive means being selectively moveable into driving engagement with one or the other of said drive trains, said first drive train comprising a gear coupled to said shaft for rotation therewith, said second drive train including a gear idly rotatable on said shaft, said second rotary drive means being mounted for axial displacement relative to the shaft between positions of driving engagement with one or the other of said gears.

2. A winch according to claim 1, in which said first rotary drive means comprises a drive sprocket and said second drive means comprises a driven sprocket, chain means providing driving engagement between said sprockets.

3. A winch according to claim 2, including manually displaceable selector means coupled with said driven sprocket, said driven sprocket being mounted on said control shaft and axially displaceable relative thereto by said selector means.

4. A winch according to claim 1, in which the gear means comprises a planetary transmission coupled with the control shaft and having planetary pinions in driving engagement with a ring gear provided on the winch head, said planetary pinions being rotatable in the same direction, though at different speed ratios, regardless of the direction of rotation of the shaft.

5. A winch according to claim 4, in which the gear means includes a free wheel coupled with the planetary transmission.

6. A winch according to claim 1, including a control assembly housing said drive means coupled with the control shaft, said control assembly comprising a first casing housing said second rotary drive means and being mounted at one end of the control shaft, and a second casing housing said first rotary drive means and being secured to said first casing.

7. A winch according to claim 6, including connecting tubes securing said first and second casings together and forming a housing for drive transmission means provided between said first and second rotary drive means.

8. A winch according to claim 6, including manually operable drive means rotatably mounted on said second casing and coupled with said first rotary drive means.

9. A winch comprising;

a housing, a control shaft rotatably mounted in said housing, a winch head mounted for rotation relative to the housing, gear means coupled with said shaft and with said winch head, and drive means coupled with said shaft to rotate the same in opposite directions, said gear means being rotatable in opposite directions by said shaft and being constituted to provide unidirectional rotation of said winch head at different speeds corresponding to the direction of rotation imparted to the gear means by said shaft, said drive means comprising a first rotary drive means, a second rotary drive means in driving engagement with said first drive means, pre-selectable first and second drive trains coupled with the shaft to apply relatively different speed ratios to said shaft, and selector means for moving said second rotary drive means into selective driving engagement with one or the other of said drive trains whereby said shaft can be driven in opposite directions at two different speeds depending on the engagement of the second rotary drive means with the first or second drive train.

10. A winch according to claim 9, in which said gear means comprises first and second pairs of bevel gears arranged to be driven by said control shaft, and a planetary transmission coupled with said first and second pairs of bevel gears and with a ring gear provided on the winch head, said first pair of bevel gears providing rotation of the winch head at a given speed ratio in one direction when the control shaft is rotated by the drive means in a first direction and said second pair of bevel gears providing rotation of the winch head at a relatively different speed ratio, also in said one direction, when the control shaft is rotated by said drive means in a second direction opposite to said first direction.

11. A winch according to claim 9 comprising a casing mounted on said shaft and containing said drive means and said selector means.

* * * * *